US006296531B1

(12) United States Patent
Nagamine

(10) Patent No.: US 6,296,531 B1
(45) Date of Patent: Oct. 2, 2001

(54) HOUSING FOR A CONNECTOR AND A CONNECTOR PRODUCED THEREWITH

(75) Inventor: Akira Nagamine, Kariya (JP)

(73) Assignee: Japan Solderless Terminal Mfr. Co., Ltd., Osaka-Fu (JP)

( * ) Notice: Subject to any disclaimer, the term of this patent is extended or adjusted under 35 U.S.C. 154(b) by 0 days.

(21) Appl. No.: 09/375,353

(22) Filed: Aug. 17, 1999

(30) Foreign Application Priority Data

Aug. 20, 1998 (JP) ..... 10-251884

(51) Int. Cl.[7] ..... H01R 13/514
(52) U.S. Cl. ..... 439/752; 439/595
(58) Field of Search ..... 439/752, 595

(56) References Cited

U.S. PATENT DOCUMENTS

| | | | | |
|---|---|---|---|---|
| 4,705,337 | | 11/1987 | Maeda . | |
| 5,299,958 | * | 4/1994 | Ohsumi | 439/752 |
| 5,609,503 | * | 3/1997 | Tsuji et al. | 439/752 |
| 5,700,162 | * | 12/1997 | Hatagishi et al. | 439/595 |
| 5,769,670 | * | 6/1998 | Abe | 439/752 |
| 5,848,919 | * | 12/1998 | Nagano | 439/752 |
| 5,879,201 | * | 3/1999 | Fukamachi et al. | 439/752 |

FOREIGN PATENT DOCUMENTS

| | | |
|---|---|---|
| 0822617 A2 | 2/1998 | (EP) . |
| 7-65924 | 3/1995 | (JP) . |
| 9-92368 | 4/1997 | (JP) . |

OTHER PUBLICATIONS

European Search Report EP 99 11 6058.

* cited by examiner

*Primary Examiner*—Paula Bradley
*Assistant Examiner*—James R. Harue
(74) *Attorney, Agent, or Firm*—Nixon Peabody LLP; Donald R. Studebaker

(57) ABSTRACT

A cavity that crosses chambers and opens in an external wall is formed in a housing proper of a housing. A retainer is slidably fitted into the cavity, and linking parts that link chambers being divided into a front portion and a rear portion by the cavity are formed in the retainer. The linking parts are arranged in such a way that when the terminals are in a regular position in the chambers, the linking parts allow the retainer to shift in the sliding direction and the retainer is secondarily fixed to the terminals by this shift. The retainer is provided to be integral with the housing proper by means of a hinge.

6 Claims, 9 Drawing Sheets

HOUSING FOR A CONNECTOR AND A CONNECTOR PRODUCED THEREWITH

BACKGROUND OF THE INVENTION

1. Field of the Invention

The present invention belongs to a technical field of a connector wherein a terminal is inserted into a chamber of a housing and the terminal is fixed by a retainer.

2. Related Art

Connectors of this kind have been known, for example, Japanese Provisional Patent Hei 7-65924 has disclosed a connector wherein, as shown in FIG. 7A, terminals (not illustrated) are stored in chambers 82 that are provided in two rows, an upper row and a bottom row, in a housing proper 81, each of these terminals is fixed by a lance (not illustrated) on an internal wall of the chamber 82, retainers 83 are provided on the top face and the bottom face of the housing proper 81, each of these retainers 83 is provided to be integral with the housing proper 81 by means of band-shaped hinges 84, and the terminals are secondarily fixed by these retainers 83. Each of these retainers 83 is tentatively fixed onto the housing proper 81 by engaging slits 85 that are provided in the left and right side ends of the retainer 83 with protrusions for tentative fixing 86 that are protrusively provided on the left and right side faces of the housing proper 81. Then the retainer 83 is fixed in a fixing position by sliding the retainer 83 forward from the position of tentative fixing and engaging the slits 85 with fixing protrusions 87 that are protrusively provided on both the left and right side faces of the housing proper 81. On the back of each retainer 83, protrusions corresponding to the respective chambers 82 of the upper or lower row are provided, and when the retainer 83 is mounted in the fixing position, each of the above-mentioned protrusions penetrates through an opening 88 that is formed in the top face of the interior of a chamber 82, protrudes into the chamber 82 and engages with a top portion of the terminal that is fixed by the lance to secondarily fix the terminal.

In this connector, as each terminal is doubly fixed to the housing, the terminals are reliably prevented from coming off the housing. Moreover, if a terminal is not inserted to a regular position at which the terminal is fixed by the lance, the retainer 83 can not fit into the top portion of the terminal. This facilitates detection of incomplete installation of the terminal. Furthermore, as each retainer 83 is provided to be integral with the housing proper 81 by means of hinges 84, the retainers 83 can be prevented from coming off the housing proper 81, and the costs can be lowered through a decrease in the number of molds and a decrease in manhour for control. To assemble the housing, hinges 84 are forced to be bent into a U-shape and the retainer 83 is moved to the position of tentative fixing, then the retainer 83 is moved further into the fixing position. During this assembly, a flat retainer fitting jig 89 as shown in FIG. 7B is used. A U-shaped bottom of a notch 90 in the jig 89 is pressed against bent portions of the hinges 84 and the retainer 83 is pushed into the position. As a result, the hinges 84 undergo plastic deformation to loose their elastic restoring forces. This prevents the retainer 83 from coming off the housing proper 81 due to the repulsive forces of the hinges 84.

However, in the above-mentioned conventional connector, as the retainers 83 are provided on the top and the bottom of the housing proper 81, only two rows of the chambers 82, an upper row and a lower row, can be provided. Chambers 82 can not be arranged in multiple rows being three or more rows. Furthermore, as the assembly of the housing is made by forcefully bending the hinges 84 into a U-shape, moving the retainer 83 into the tentative fixing position and then moving the retainer 83 into the fixing position, it takes much time and workability is low. Moreover, as the retainer 83 must be pushed into position by means of the retainer fitting jig 89 to eliminate elastic restoring forces of the hinges 84, this also lowers workability.

SUMMARY OF THE INVENTION

The present invention was made in view of these points. One objective of the present invention is to make double fixing and detection of incomplete fitting by means of a retainer. Another objective is to make the retainer integral with the housing proper so as to prevent the retainer from coming off and reduce the costs. Another objective is to enable multiple stacking of chambers in three or greater rows by fitting the retainer in the housing proper in such a way that the retainer crosswise penetrates chambers of the housing proper and shifting the retainer to secondarily fix terminals. Another objective is to eliminate the needs of greatly bending the hinges so as to save time of housing assembly and improve workability while preventing the retainer from coming off the housing proper.

To accomplish the above-mentioned objectives, the present invention is a housing for a connector in which terminals are to be fixed, comprising a housing proper having chambers into which said terminals are inserted and having a cavity that crosses said chambers and opens in at least one external wall, a retainer being slidably fitted in said cavity of said housing proper, having a linking part that links said chambers that are divided into a front portion and a rear portion by said cavity, being shiftable in a sliding direction when said terminals are in a regular position in said chambers, and being secondarily fixed to said terminals by said shift, and at least one hinge integrally connecting said retainer with said housing proper.

In this housing, when a terminal is inserted into a chamber, the terminal is fixed in the housing. When a retainer is to be shifted in the sliding direction, the terminals must be in a regular position in the chambers. Otherwise the retainer can not be shifted. In this case, incomplete fitting is detected. When the terminals are in a regular position in the chambers, the retainer can be shifted, and the retainer is secondarily fixed to the terminals by this shift. In this case, as the retainer is integral with the housing proper by means of the hinge, the retainer is prevented from coming off the housing proper, and the costs can be lowered. If the housing proper is provided with chambers in three or more rows in the sliding direction of the retainer, a linking part that links respective chambers can be formed in the retainer, and in that case both secondary fixing and detection of incomplete fitting can be made. Moreover, as the retainer is moved almost linearly by a short distance in the sliding direction, the hinge will not be bent greatly and no large elastic restoring force will work on the hinge. Accordingly, the retainer will not come off the housing proper. Furthermore, as no special jig is used, just a shift of the retainer is needed and that can be done by a single touch, the work of assembling the housing is reduced and workability is improved.

In the housing for a connector according to the present invention, the holding power of the terminals is enhanced through double fixing with the retainer, and incomplete fitting of any terminal can be detected to reliably prevent misassembly. As the retainer is integral with the housing proper by means of the hinge, the retainer can be prevented from coming off the housing proper and the costs can be reduced. As the retainer is fitted into the housing proper in such a way that the retainer crosses the chambers of the housing proper and the retainer is made to secondarily fixing the terminals by shifting the retainer in the sliding direction, the chambers can be arranged in multiple rows, namely, three or more rows, moreover, as there is no need of bending the hinge greatly, the work of assembling the housing can be reduced and workability can be enhanced while preventing the retainer from coming off the housing proper.

BRIEF DESCRIPTION OF THE DRAWINGS

FIG. 1A shows a state before secondarily fixing terminals by means of a retainer. FIG. 1B shows a state after secondarily fixing terminals by pushing the retainer upward.

FIG. 2A is a plan view and FIG. 2B is a front view.

FIG. 3A shows a state before secondarily fixing the terminals with the retainer. FIG. 3B shows a state after secondarily fixing the terminals by pushing the retainer upward.

FIG. 4A shows a state before secondarily fixing the terminals with the retainer. FIG. 4B shows a state after secondarily fixing the terminals by pushing the retainer upward.

FIG. 6A shows a state before secondarily fixing terminals with a retainer. FIG. 6B shows a state after secondarily fixing terminals by pushing the retainer upward.

FIG. 7A is a perspective view of a housing for a connector. FIG. 7B is a sectional view showing a state wherein the bottom of a notch of a retainer fitting jig is pressed against bends of hinges to push a retainer into the housing.

PREFERRED EMBODIMENTS OF THE INVENTION

Figure 1A:
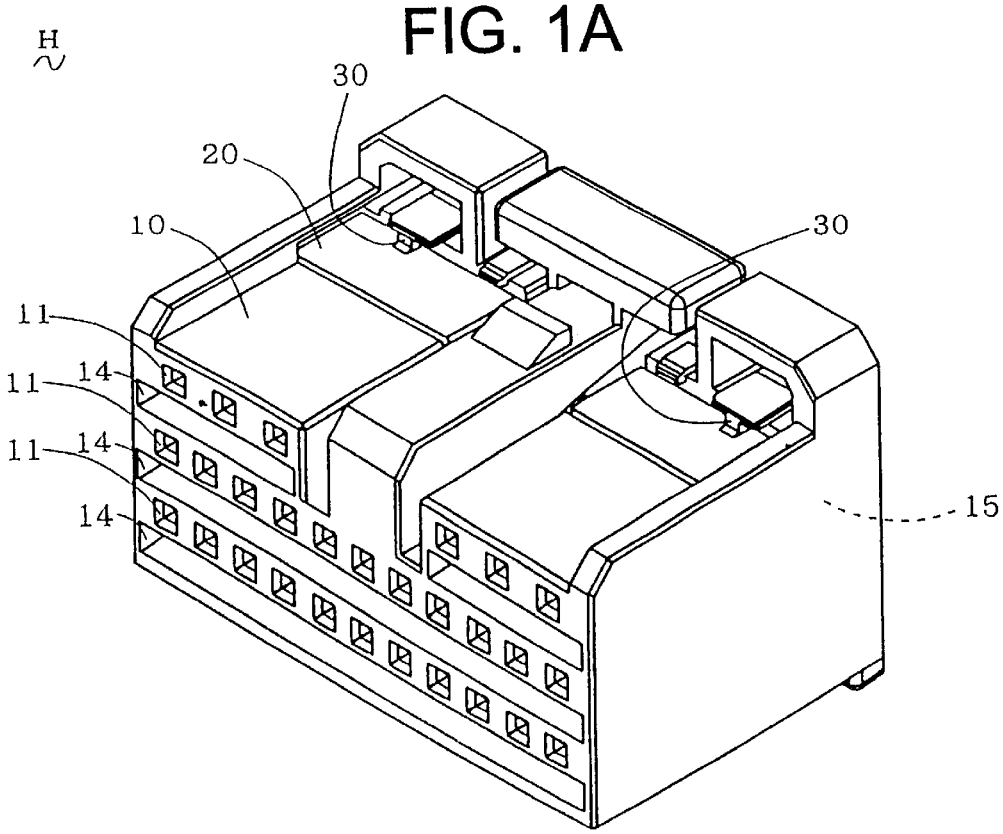
FIG. 1A and FIG. 1B are perspective views showing a housing for a connector of a first embodiment.
Figure 1B:
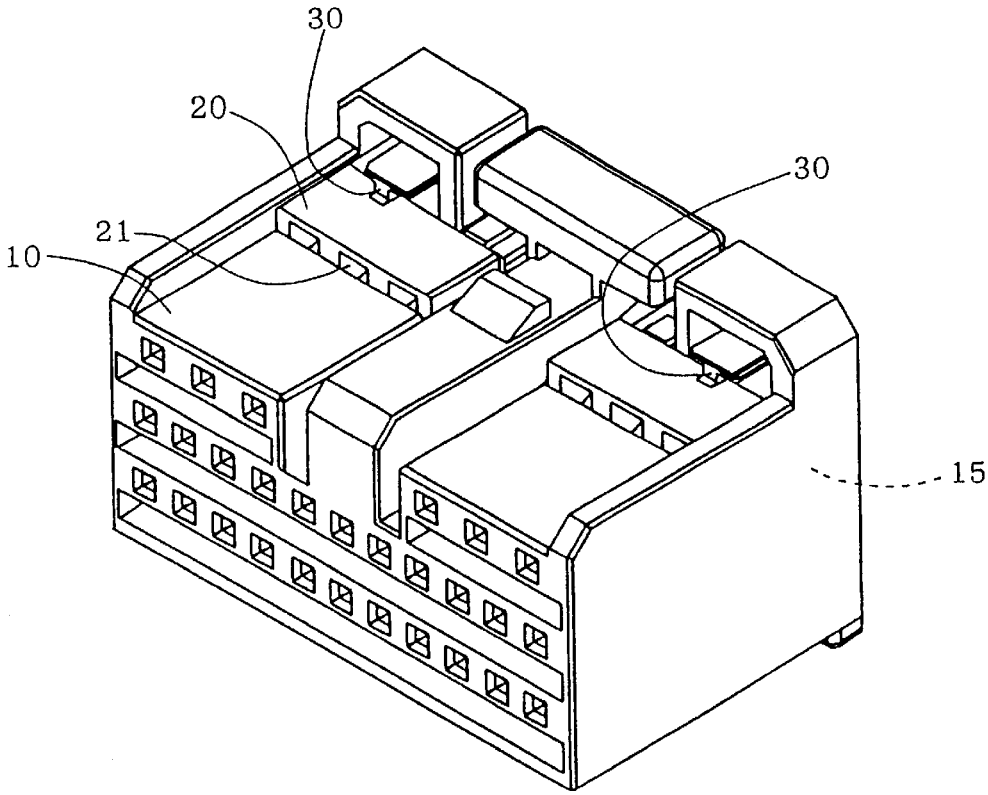
Figure 2A:
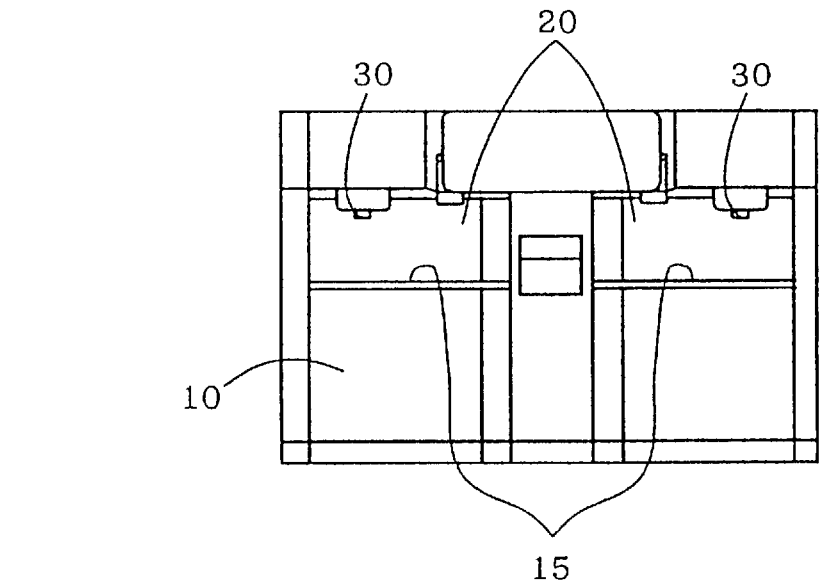
FIG. 2A and FIG. 2B show the housing for a connector of the first embodiment.
Figure 2B:
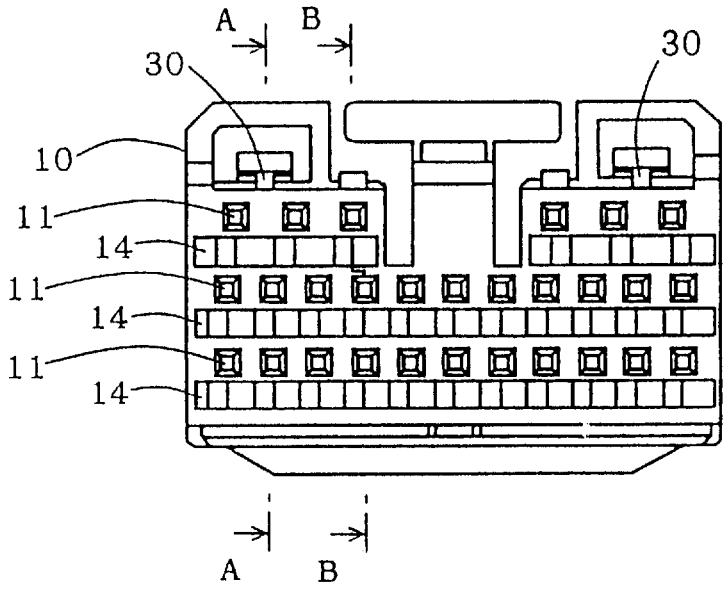

In the following, embodiments of the present invention will be described with reference to the drawings. FIG. 1A through FIG. 2B show a housing H according to the first embodiment. FIG. 3A through FIG. 5A show a connector C wherein terminals T are inserted into chambers 11 of the housing H.

In FIG. 1A through FIG. 2B, 10 denotes a housing proper. In this housing proper 10, chambers 11 are formed through in the front-rear direction of the housing proper 10 (hereinafter the front-rear direction of the housing proper 10 is simply referred to as the front-rear direction). These chambers 11 are formed parallel with each other in several rows in the height direction of the housing proper 10 (hereinafter simply referred to as the height direction) and in several columns in the width direction of the housing proper 10 (hereinafter simply referred to as the width direction). A terminal T is inserted and fixed in each chamber 11.

As shown in FIG. 3A through FIG. 5, the above-mentioned terminal T is formed to have a configuration that can be inserted into the chamber 11 of the housing proper 10, for example, a tubular form. At the front end of the terminal T, a stabilizer 4 having a face being in the width direction is erected in the height direction. An insertion port 1 into which a terminal of a counterpart connector is inserted is opened in the front end of the above-mentioned terminal T. A splicing part 2 to which an electric wire is connected is provided in the rear of the terminal T, and the core of the electric wire W is connected to the splicing part 2 by crimping, soldering, etc. Inside the front half part of the above-mentioned terminal T, a leaf spring (not illustrated) that can be flexed in, for example, the height direction or the width direction is formed. When the terminal of the counterpart connector is inserted, the leaf spring is pressed to contact the terminal of the counterpart connector.

The above-mentioned housing proper 10 is provided with grooves 12, each of which is formed from each chamber 11 in the height direction, extends in the front-rear direction and receives the stabilizer 4 of the above-mentioned terminal T, lances 13, each of which is formed in the above-mentioned groove 12 in such a way that the lance 13 can flex in the width direction of the chamber 11 and fixes the stabilizer 4 by the front part thereof, and test windows 14, each of which allows access from the front to the groove 12 on the front side of the lance 13. Accordingly, when the terminal T is inserted into the chamber 11 of the housing H, the above-mentioned stabilizer 4 will fit into the above-mentioned groove 12, move ahead, go beyond the lance 13 that is formed in the groove and settle on the front side of the lance 13 to be fixed by the lance 13.

In the above-mentioned housing proper 10, a cavity 15 that crosses all the chambers 11 in the height direction and opens in both the top and bottom external walls is formed. A retainer 20 is slidably fitted in this cavity 15, and linking parts 21 that link the chambers 11 that are divided by the above-mentioned cavity 15 into front chambers 11*a* and rear chambers 11*b* are formed in the retainer 20 in relation with all the chambers 11. A fixing part 3 that is notched in the sliding direction of the above-mentioned retainer 20 (the height direction in this embodiment) is formed in an intermediate part of each terminal T in the front-rear direction thereof. This fixing part 3 is arranged in such a way that when the terminal T is inserted into the regular position in the chamber 11, the front end 3*a* of the fixing part 3 will coincide with the rear end 11'*a* of the front chamber 11*a* of the housing H and a circumferential wall 22 of the linking part 21 can be fitted into the above-mentioned fixing part 3 by shifting the retainer 20 in the sliding direction.

Figure 3A:
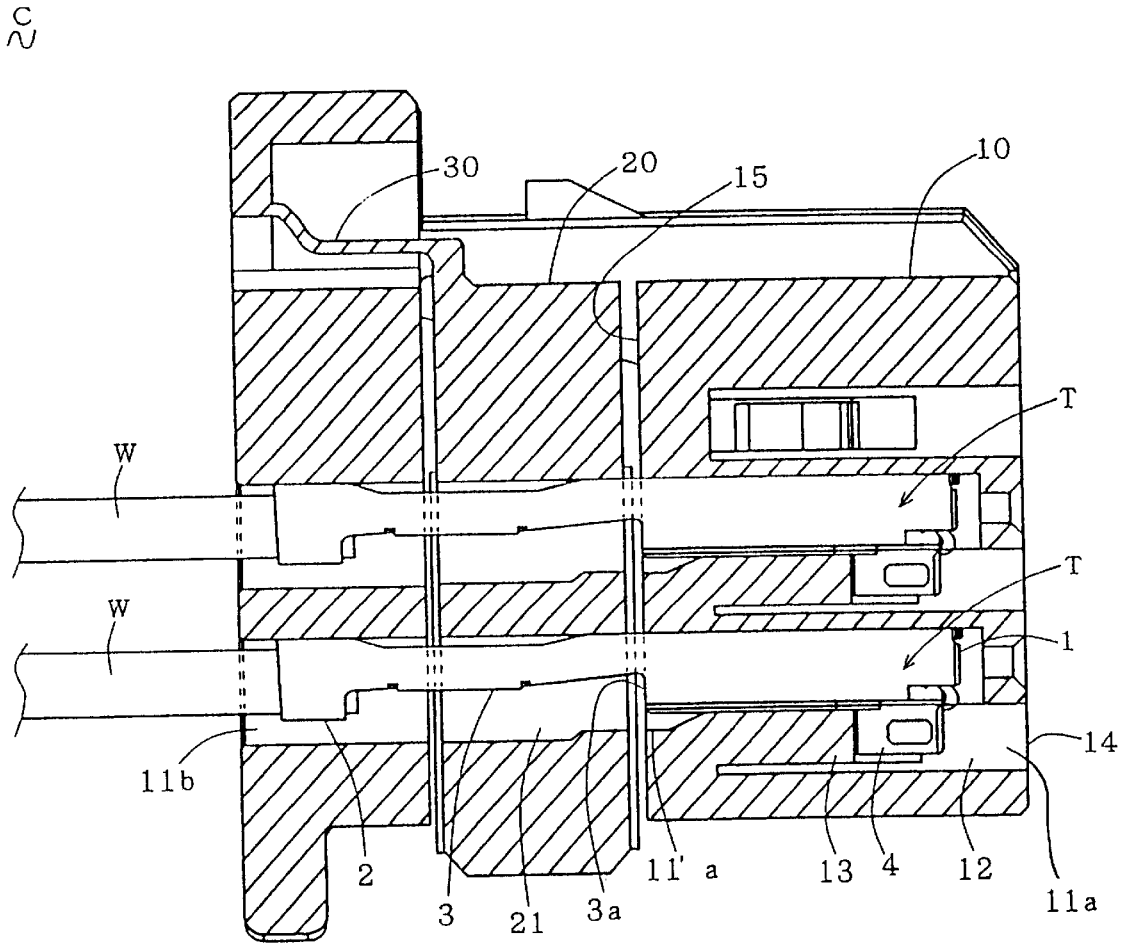
FIG. 3A and FIG. 3B are enlarged sectional views along the line A—A of FIG. 2B.
Figure 3B:
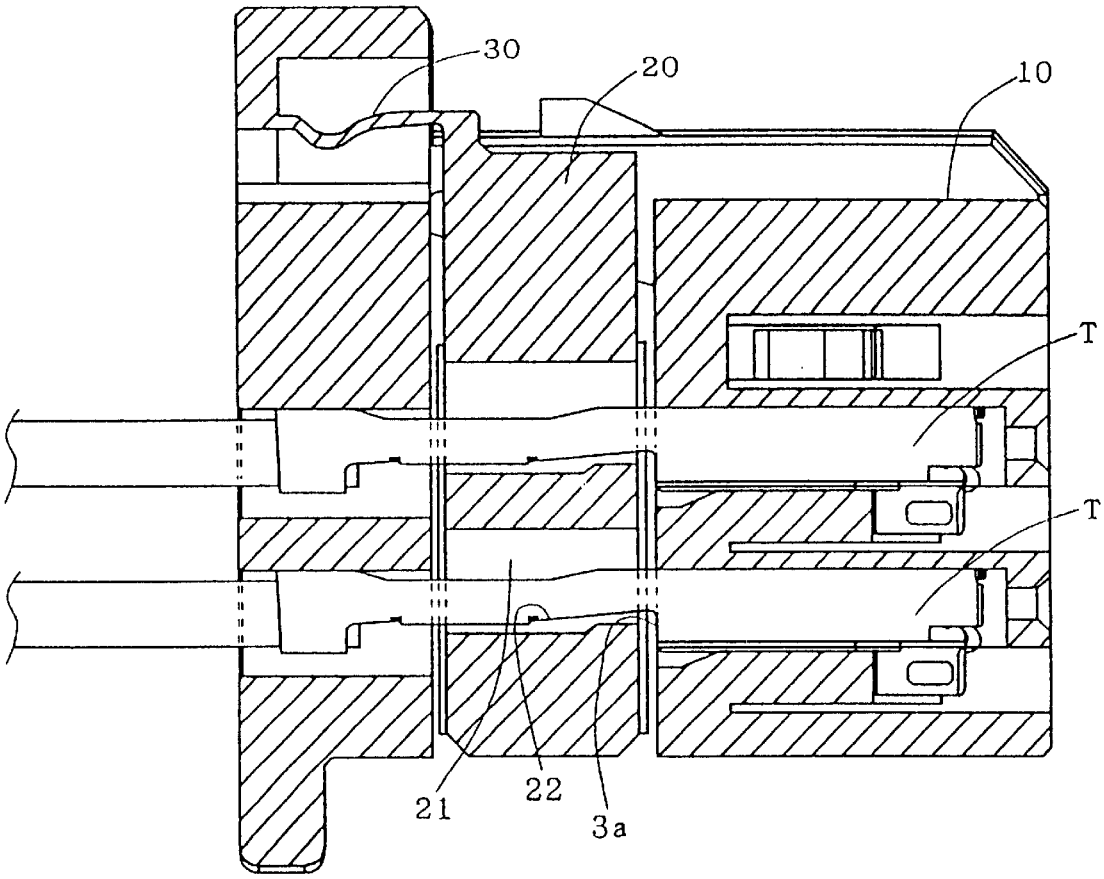
Figure 4A:
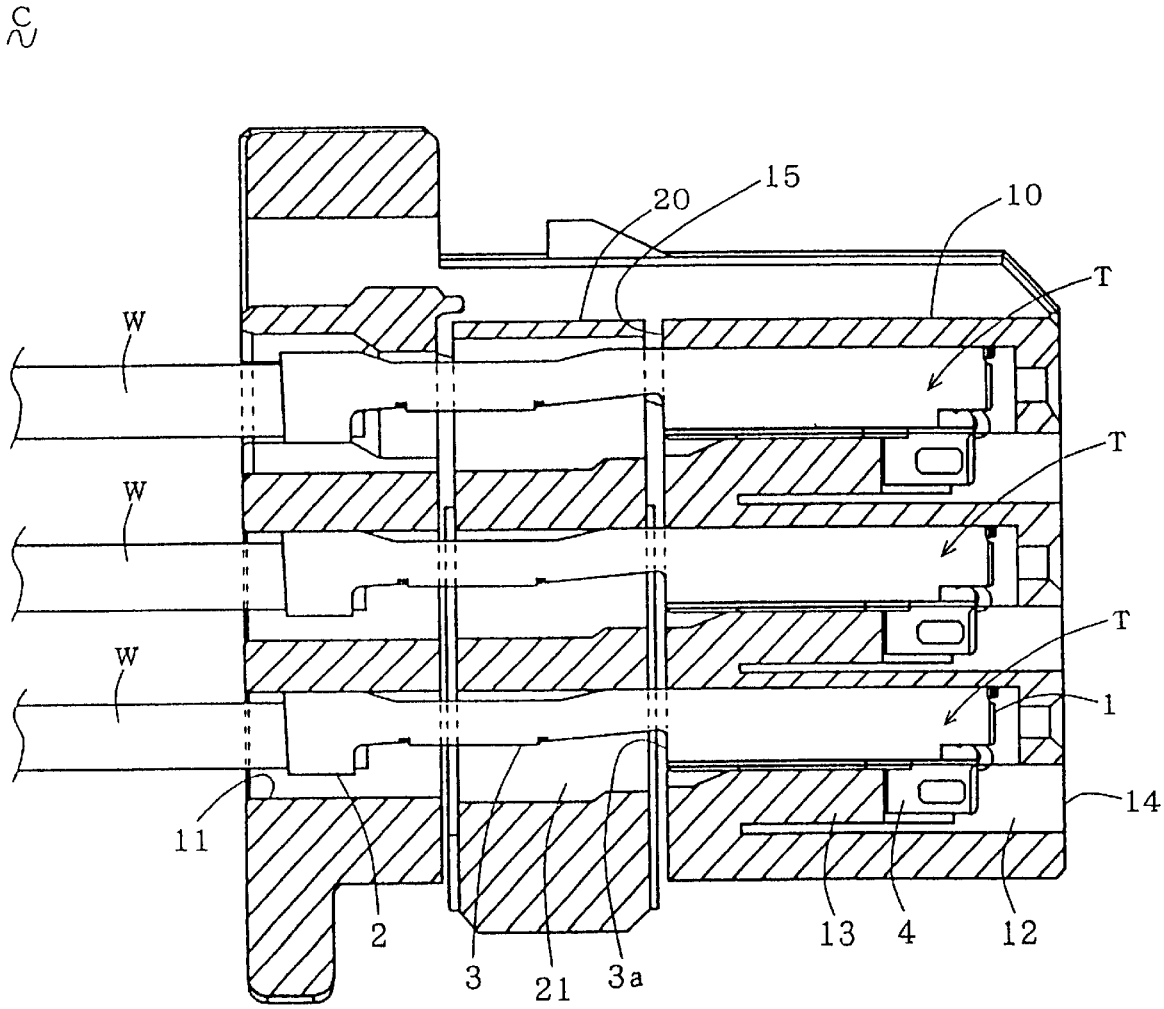
FIG. 4A and FIG. 4B are enlarged sectional views along the line B—B of FIG. 2B.
Figure 4B:
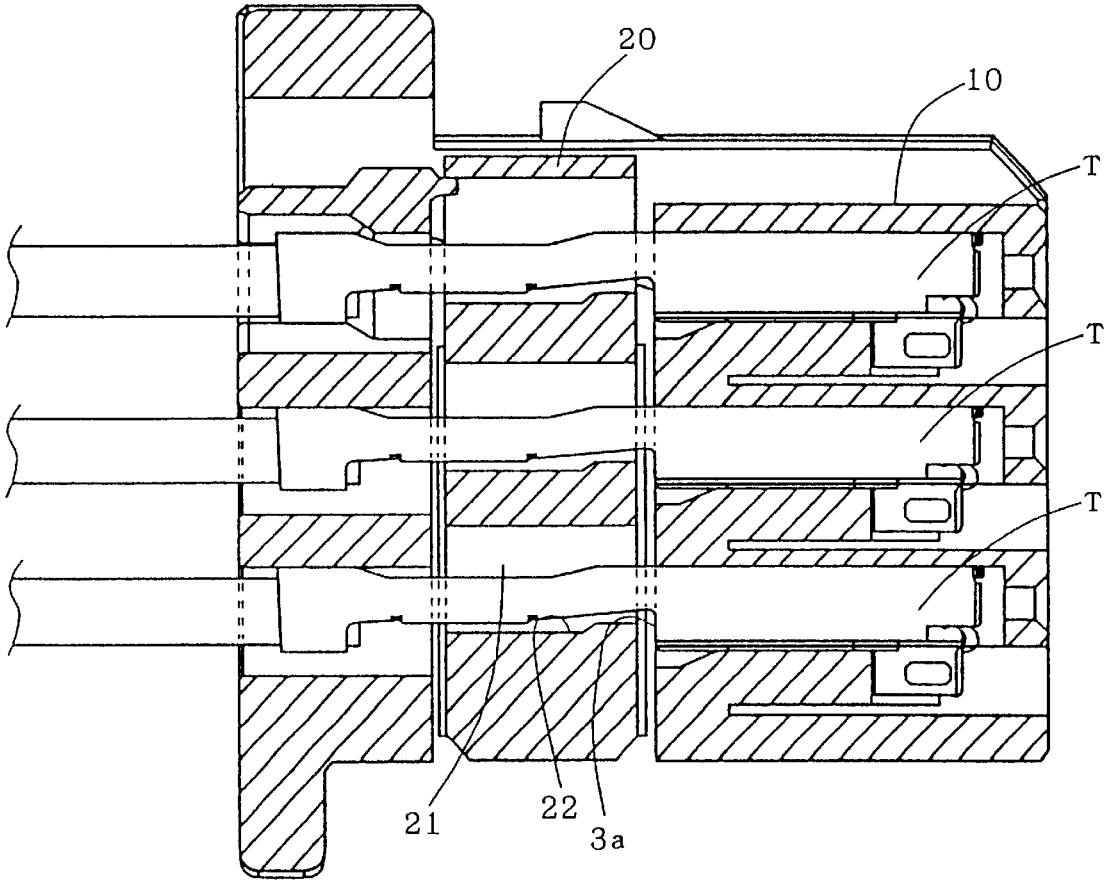
Figure 5:
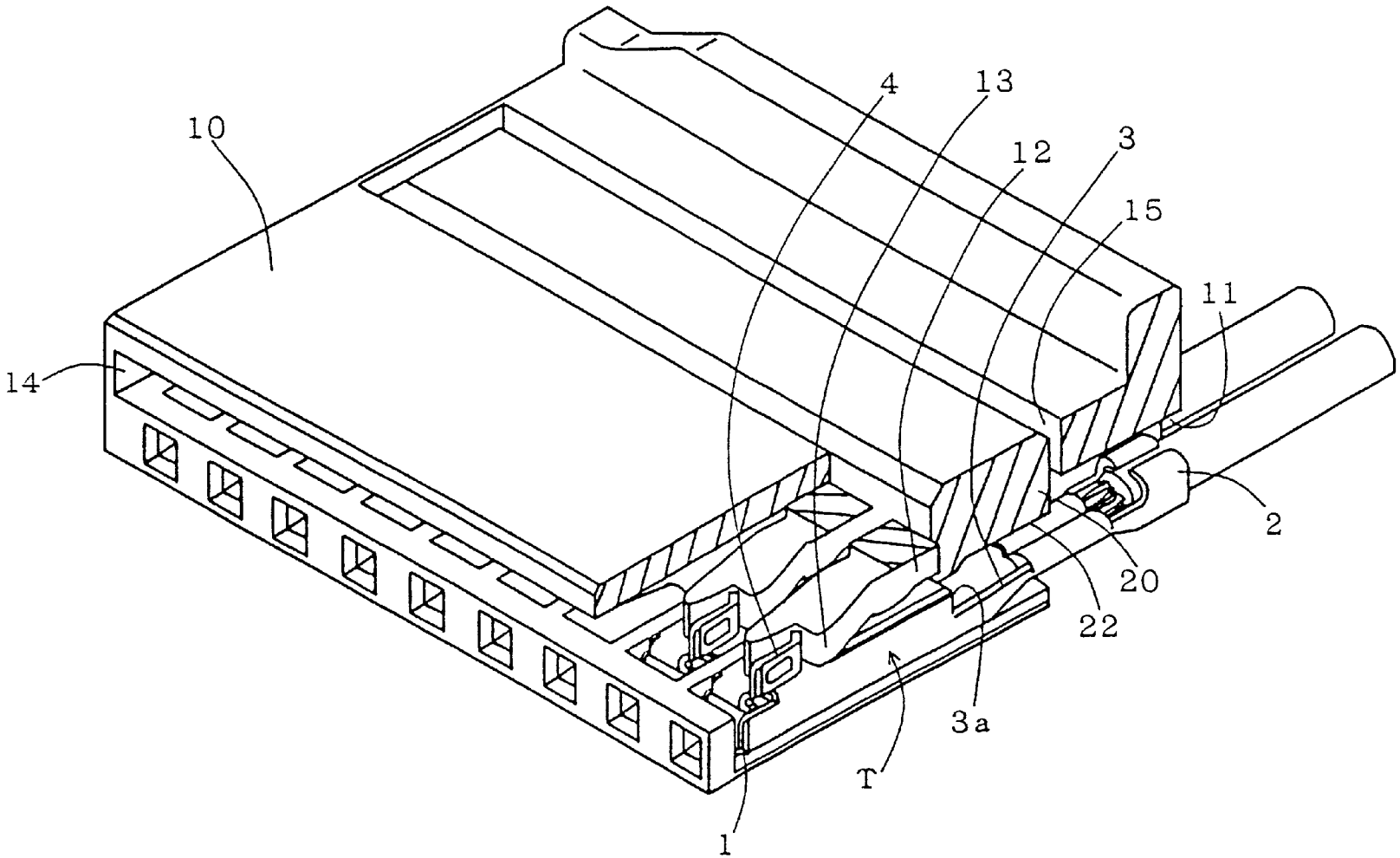
FIG. 5 is a partially cutaway enlarged view of chambers of the lowest row of the connector of the first embodiment. The connector is seen from the bottom side.

As shown in FIG. 3A and FIG. 3B, the above-mentioned retainer 20 is provided to be integral with the housing proper 10 by means of hinges 30. The hinges 30 being in a form of band are provided at two locations that are distant from each other in the width direction on the top of the housing proper 10. Each hinge 30 extends in the front-rear direction to bridge between and connect the retainer 20 and the housing proper 10 together. The housing proper 10, hinges 30 and the retainer 20 are molded integral with each other. The above-mentioned hinges 30 are arranged to swing within a small angle around their edges on the housing proper side when the retainer 20 is shifted in the sliding direction.

Accordingly, in the above-mentioned first embodiment, when an electric wire W is connected to the splicing part 2 of the terminal T and the terminal T is inserted into the chamber 11 of the housing H, the stabilizer 4 will fit into the groove 12 of the housing H, move forward, go beyond the lance 13 of the housing H and get fixed by the lance 13. Thus the terminal T is primarily fixed to the housing H (the state shown in FIG. 1A, FIG. 3A and FIG. 4A). When the retainer 20 is to be shifted in the sliding direction, if the terminal T is not in the regular position in the chamber 11, as the top end 3*a* of the fixing part 3 is protruding backward beyond the rear end 11'*a* of the front chamber 11*a* of the housing H, an attempt to shift the retainer 20 in the sliding direction will be hindered by the front end 3*a* of the fixing part 3. Thus incomplete fitting will be detected. On the other hand, if the terminal T is in the regular position in the chamber 11, the front end 3*a* of the fixing part 3 coincides with the rear end 11'*a* of the front chamber 11*a* of the housing H, the circumferential wall 22 of the linking part 21 of the retainer 20 will fit into the above-mentioned fixing part 3 and the retainer 20 can be shifted. The retainer 20 is secondarily fixed to the terminal T by this shift (the state shown in FIG. 1B, FIG. 3B and FIG. 4B). When this connector C is connected with a counterpart connector, terminals of the counterpart connector will be inserted into the respective terminals T and leaf springs or the like will be pressed to contact the terminals of the counterpart connector to make mechanical connections and electrical connections between both connectors. In this case, as the retainer 20 is integral with the housing proper 10 by means of the hinges 30, the retainer 20 is prevented from coming off the housing proper 10 and the costs can be reduced through reduction in the number of molds, manhour for control, etc. Even if chambers 11 are formed in the housing proper 10 in three or more rows in the sliding direction of the retainer 20, linking parts 21 that link respective chambers 11 can be formed in the retainer 20, and secondary fixing and detection of incomplete fitting of each terminal can be made. Moreover, it is possible to install terminals T of multiple kinds differing in width or height or terminals T of which spacing (pitch) in the width direction or the height direction differs. As the retainer 20 is shifted almost linearly over just a short distance in the sliding direction, the hinges 30 will not be bent greatly, for example, into a U-shape. Thus no excessive elastic restoring forces will work on the hinges 30. Hence the retainer 20 will not come off the housing proper 10. Furthermore, no special jig such as the retainer fitting jig that was described in the prior art is used. The retainer 20 is merely shifted by hand or a manipulator and this shifting can be done by a single touch. Hence the work of housing assembly is reduced and workability is improved.

The present invention includes all embodiments wherein the stabilizer 4 is erected in any position on the external side of the terminal. If the stabilizer 4 is provided at the top end of the terminal as is the case of the above-mentioned first embodiment, when the terminal T is inserted into the chamber 11 of the housing H in a wrong orientation, for example, upside down, the stabilizer 4 will be caught on the entrance of the chamber 11 in the first stage of insertion. Thus inverse insertion of the terminal T can be reliably prevented, and in turn, damages to the housing H due to misoperation, etc. of the workers can be avoided.

Furthermore, the present invention includes embodiments wherein only chambers 11 open their ports in the front face of the housing H. In such an embodiment if, for example, a continuity test is made on the connector C in a conventional manner by inserting a terminal of a counterpart connector or a test jig having the same configuration as the terminal of the counterpart connector into the insertion port 1 of the terminal T, the terminal of the counterpart connector or the like may be deformed due to repeated use. If the deformed terminal is inserted, a trouble or damage to the leaf spring, etc. of the terminal T of the connector C may occur. In contrast, if a test window 14 allowing direct access to the stabilizer 4 is opened in the front of the housing H as is the case of the above-mentioned first embodiment, when the terminal of the counterpart connector or the like is inserted into the test window 14 instead of the insertion port 1 of the terminal T, the terminal of the counterpart connector or the like will contact the stabilizer 4. Thus a continuity test, etc. can be made without damaging the leaf spring, etc. of the terminal T.

As for the stabilizer 4, it is sufficient to form it in such a way that it can fit into the groove 12 and advance forward and has a face being in the width direction or the height direction. According to the conditions of the stabilizer 4, the groove 12 is formed from each chamber 12 in the height direction or the width direction, and the lance 13 is formed so that it can flex in the width direction or the height direction. When the stabilizer 4 is formed so that the lance 13 is flexed in the width direction as is the case of the above-mentioned first embodiment, with the advancement of the stabilizer 4, the lance 13 of the housing H will be flexed in the width direction. Hence there is no need of providing the housing H with a space for flexing in the height direction. Thus the height of the housing H is lowered. Accordingly, the connector C can be compactified in the height direction as much as possible. In particular, in a connector C wherein chambers 11 are arranged in several rows in the height direction, several terminals T are present at intervals in the height direction and the number of walls between chambers is increased. The connector C can be compactified greatly in the height direction by lowering the height of the respective terminals T and thinning the walls between chambers 11. Because of these properties, this connector C is suitable, for example, as a connector for cars in which space utility is demanded vigorously.

Figure 6A:
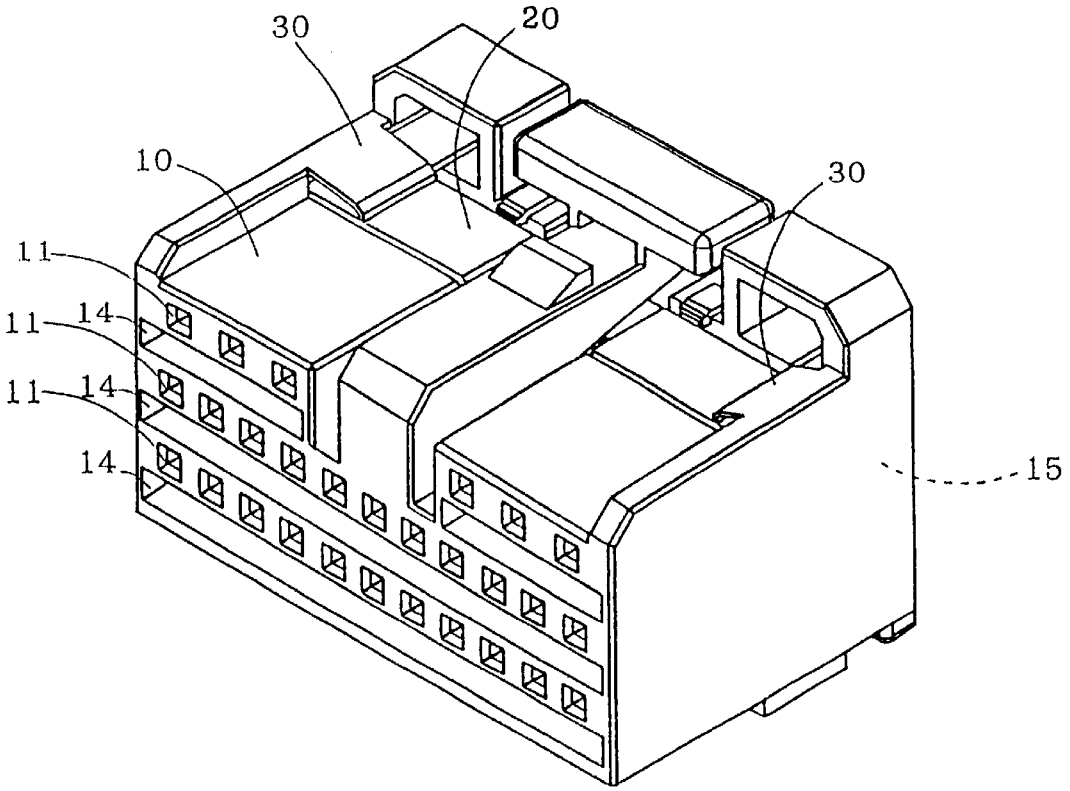
FIG. 6A and FIG. 6B are perspective views of a housing for a connector of a second embodiment.
Figure 6B:
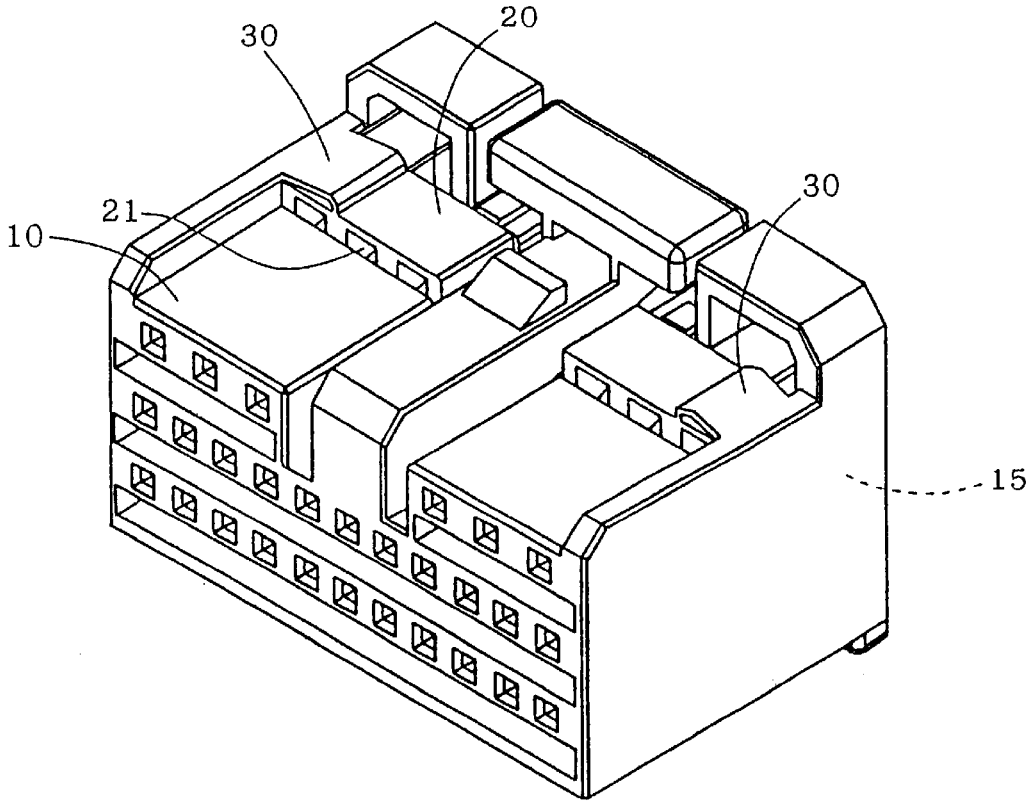
Figure 7A:
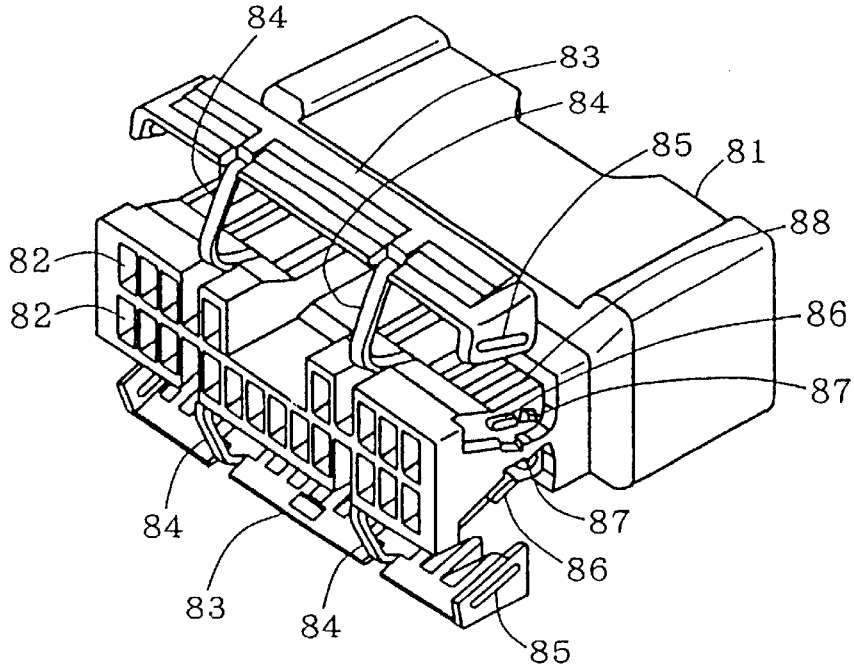
FIG. 7A and FIG. 7B show a conventional housing.
Figure 7B:
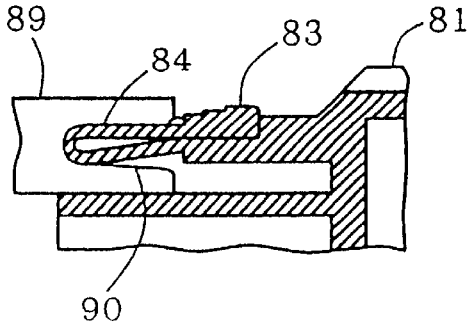

FIG. 6A and FIG. 6B shows the second embodiment. This embodiment differs from the first embodiment only in the configuration around the hinges 30. Accordingly, identical marks are given to members that exhibit identical functions of the members of the first embodiment. The description of the first embodiment except a portion concerning the configuration of the hinges 30 is quoted intact as the description of the second embodiment. The description of the hinges 30 in the second embodiment is as follows. As shown in FIG. 6A and FIG. 6B, the retainer 20 is provided to be integral with the housing proper 10 by means of the hinges 30. The hinges 30 being in a form of band are provided at both ends of the top of the housing proper 10 in the width direction. Each hinge 30 extends in the width direction to bridge between and connect the retainer 20 and the housing proper 10 together. The housing proper 10, hinges 30 and the retainer 20 are molded integral with each other. The above-mentioned hinges 30 are arranged to swing within a small angle around their edges on the housing proper side when the retainer 20 is shifted in the sliding direction. The operations and actions of the second embodiment are similar to those of the first embodiment.

The present invention is not limited in any way by the configurations of the above-mentioned embodiments. In the above-mentioned embodiments, the fixing part 3 that is notched in the sliding direction of the retainer 20 is formed in the terminal T, and this fixing part 3 is arranged in such a way that when the terminal T is inserted into the regular position in the chamber 11, the front end 3*a* of the fixing part 3 will coincide with the rear end 11'*a* of the front chamber 11*a* of the housing H and a circumferential wall 22 of the linking part 21 can be fitted into the above-mentioned fixing part 3 by shifting the retainer 20 in the sliding direction. The present invention, however, includes all embodiments that are arranged in such a way that when the terminal T is in the regular position in the chamber 11, the retainer 20 is allowed to shift in the sliding direction and this shift makes the retainer 20 be secondarily fixed to the terminal T. Accordingly, the present invention includes, for example, an embodiment wherein the fixing part 3 that is notched in the sliding direction of the retainer 20 is formed in the terminal T, and an engaging part such as a protrusion, that coincides with the fixing part 3 in the front-rear direction and can be engaged with the fixing part 3 when the terminal T is inserted in the regular position in the chamber 11, is formed on the retainer 20. In the above-mentioned embodiments, the terminal T that is inserted into the chamber 11 is primarily fixed by the lance 13. The present invention, however, includes embodiments of a housing for a connector that uses any one of other known means of primary fixing and embodiments of a connector using said housing. The form of the hinges is not limited to bands. They can take any forms, for example, bars. The present invention also includes all embodiments where the cavity 15 is opened only in one external wall of the housing 10, embodiments wherein one hinge 30 is provided or three or more hinges 30 are provided, embodiments the hinge 30 is formed inside the cavity 15 and combinations of these embodiments.

What is claimed is:

1. A housing for a connector in which terminals are to be fixed, said housing comprising:

a plurality of chambers into which said terminals are inserted, at least one cavity that crosses said plurality of chambers and opens in two external walls of said housing to divide said plurality of chambers into a front portion and a rear portion, at least one retainer being slidably fitted into said at least one cavity of said housing, said at least one retainer having a linking part that links said plurality of chambers, said at least one retainer being shiftable in a sliding direction when said terminals are in a regular position in said plurality of chambers, and being secondarily fixed to said terminals by said shift, and at least one hinge integrally connecting said at least one retainer with said housing.

2. A housing for a connector of claim 1 wherein said at least one hinge being in a form of a band is provided at two locations that are distant from each other in the width direction on the top of said housing, said at least one hinge extending in the front-rear direction to connect said at least one retainer and said housing and wherein said housing, said at least one hinge and said at least one retainer are molded integral with each other.

3. A housing for a connector of claim 1 wherein said at least one hinge being in a form of a band is provided at both ends in the width direction on the top of said housing, said at least one hinge extending in the width direction to connect said at least one retainer and said housing, and wherein said housing, said at least one hinge and said at least one retainer are molded integral with each other.

4. A connector wherein terminals are inserted into said plurality of chambers of a housing of claim 1 wherein a fixing part is notched in said terminal in the sliding direction of said at least one retainer, and said fixing part is arranged in such a way that when said terminal is inserted into the regular position in a respective one of said plurality of chambers, the front end of said fixing part will coincide with the rear end of the front chamber of said housing and a circumferential wall of said linking part is fitted into said fixing part by shifting said retainer in the sliding direction.

5. A connector wherein terminals are inserted into said plurality of chambers of a housing of claim 2 wherein a fixing part is notched in said terminal in the sliding direction of said at least one retainer, and said fixing part is arranged in such a way that when said terminal is inserted into the regular position in a respective one of said plurality of chambers, the front end of said fixing part will coincide with the rear end of the front chamber of said housing and a circumferential wall of said linking part is fitted into said fixing part by shifting said retainer in the sliding direction.

6. A connector wherein terminals are inserted into said plurality of chambers of a housing of claim 3 wherein a fixing part is notched in said terminal in the sliding direction of said at least one retainer, and said fixing part is arranged in such a way that when said terminal is inserted into the regular position in a respective one of said plurality of chambers, the front end of said fixing part will coincide with the rear end of the front chamber of said housing and a circumferential wall of said linking part is fitted into said fixing part by shifting said retainer in the sliding direction.

* * * * *